US006401618B1

(12) United States Patent
Cheung et al.

(10) Patent No.: US 6,401,618 B1
(45) Date of Patent: Jun. 11, 2002

(54) PRINTING MACHINE HAVING RECIPROCATING CARRIAGE CARRYING BOTH CLEANING AND INK DELIVERY DEVICES

(75) Inventors: Wai Cheung, Middlesbrough; Edward H. Hutchinson, Durham, both of (GB)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 09/356,621

(22) Filed: Jul. 19, 1999

(30) Foreign Application Priority Data

Jul. 17, 1998 (GB) ..... 9815635

(51) Int. Cl.[7] ..... B41F 35/02; B41F 31/08

(52) U.S. Cl. ..... 101/425; 101/350.6; 101/351.8; 101/424; 15/256.53

(58) Field of Search ..... 101/351.8, 425, 101/350.6, 350.2, 150, 153, 155, 157, 167, 169, 423, 424, 364, 365, 366, 424.1; 15/256.53, 256.51; 134/172, 198, 94.1, 95.1, 95.3; 399/249, 343, 345

(56) References Cited

U.S. PATENT DOCUMENTS

| | | | | | |
|---|---|---|---|---|---|
| 1,568,299 | A | | 1/1926 | Stevens | |
| 2,177,656 | A | | 10/1939 | Kaddeland | 101/157 |
| 2,377,089 | A | * | 5/1945 | Lundbye | 101/157 |
| 3,292,201 | A | | 12/1966 | Bedard | 15/308 |
| 3,521,561 | A | | 7/1970 | Pali et al. | 101/169 |
| 3,837,275 | A | | 9/1974 | Madsen | 101/207 |
| 4,019,816 | A | | 4/1977 | Bernhard | 355/3 P |
| 4,024,813 | A | | 5/1977 | Thiene et al. | 101/269 |
| 4,092,922 | A | * | 6/1978 | Schweitzer | 101/364 |
| 4,192,231 | A | * | 3/1980 | Kawakami | 101/425 |
| 4,222,328 | A | | 9/1980 | Doyle | 101/366 |
| 5,003,876 | A | * | 4/1991 | Harrison et al. | 101/425 |
| 5,111,747 | A | * | 5/1992 | Kobler et al. | 101/157 |
| 5,169,704 | A | | 12/1992 | Faust et al. | 428/143 |
| 5,184,556 | A | | 2/1993 | Schaeuble | 101/483 |
| 5,222,432 | A | | 6/1993 | Schaede | 101/157 |
| 5,239,925 | A | * | 8/1993 | Bobo | 101/366 |
| 5,477,782 | A | * | 12/1995 | Nguyen | 101/157 |
| 5,564,338 | A | * | 10/1996 | Branas | 101/425 |
| 5,614,933 | A | | 3/1997 | Hindman et al. | 347/103 |
| 5,628,250 | A | | 5/1997 | Weisbrod | 101/363 |
| 5,688,552 | A | | 11/1997 | Lacomis et al. | 427/140 |
| 5,805,191 | A | | 9/1998 | Jones et al. | 347/103 |

FOREIGN PATENT DOCUMENTS

| | | | | |
|---|---|---|---|---|
| DE | 261125 | | 6/1913 | |
| DE | 272647 | | 4/1914 | |
| EP | 0 556 460 | A1 | 11/1992 | |
| EP | 0 538 190 | A1 | 4/1993 | |
| EP | 0 722 833 | A2 | 12/1995 | |
| EP | 0 813 962 | A2 | 6/1997 | |
| EP | 0 974 462 | A2 | 7/1999 | |
| GB | 670175 | | 3/1949 | |
| GB | 730336 | | 3/1953 | |
| GB | 787262 | | 3/1955 | |
| GB | 1406563 | * | 9/1975 | 101/425 |
| GB | 2294662 | | 10/1995 | |
| JP | 0 824 4200 | A | 9/1996 | |

OTHER PUBLICATIONS

European Search Report—EP 0974462A3, Apr. 2000.

* cited by examiner

*Primary Examiner*—Leslie J. Evanisko
(74) *Attorney, Agent, or Firm*—Womble Carlyle Sandridge & Rice, PLLC

(57) ABSTRACT

A rotary printing machine having a cylinder, two doctor blades acting on the cylinder, and a gravity fed ink dispensing mechanism and a drum cleaning spray system provided on a reciprocating carriage. Ink is applied in excess to one of the doctor blades and excess ink is removed by the other. One of the ink dispensing mechanisms can be removed and replaced while printing is taking place using ink from the other ink dispensing mechanism.

9 Claims, 2 Drawing Sheets

PRINTING MACHINE HAVING RECIPROCATING CARRIAGE CARRYING BOTH CLEANING AND INK DELIVERY DEVICES

REFERENCE TO RELATED APPLICATION

This application claims the benefit, pursuant to 35 U.S.C. §119, of the filing date of previously file UK Patent Application No. 98.15635.9 filed Jul. 17, 1998.

BACKGROUND

A type of rotary gravure printing machine is well known in which the printing cylinder is mounted with its axis horizontal, and its lowest portion dipping into a pan of printing ink. A doctor blade on the rising side of the cylinder removes ink from the lands, and the top of the cylinder is in rolling contact with a moving web of material, to which the ink remaining in the recesses of the cylinder is transferred. Because of the open pan of ink, solvent evaporates from the ink, and it is therefore necessary to have a complicated system of pipes and pumps to circulate the ink in order to keep it reasonably uniform in consistency and colour. In addition, bubbles may form on the surface of the ink in the pan, which then leave visible flaws in the printing. If it is desired to change ink in order, for example, to print the same pattern in a different colour scheme, it is necessary to drain and clean out the pan, the pipes, and the pumps, as well as to clean the actual printing cylinder. That necessitates stopping the printing machine for a considerable period of time, and the loss of a significant amount of ink, which may be expensive, and generates substantial quantities of wash liquid contaminated with ink, all of which must be disposed of properly.

U.S. Pat. No. 2,177,656 proposes a gravure printing press in which the ink is applied directly to the cylinder under pressure from within an elongate, hollow applicator assembly, the surplus ink being scraped off and recirculated by means of an adjacent doctor blade. A system of pipes and pumps is provided to ensure a constant supply of ink at the applicator.

There has recently been introduced a gravure printing machine in which ink is fed onto the upper side of a doctor blade on the descending side of the cylinder. The ink is delivered at a single point, at the center of the doctor blade, and allowed to spread freely along the blade.

SUMMARY OF THE INVENTION

The present invention provides a rotary printing machine comprising a carriage that is arranged to reciprocate along the cylinder, and to carry a device arranged to deliver ink directly along the surface of the cylinder or along a doctor blade acting on the cylinder.

The present invention also provides a method of rotary printing that comprises delivering ink directly along the surface of the cylinder or along a doctor blade acting on the cylinder by means of a device carried by a carriage that is arranged to reciprocate along the cylinder.

The invention is especially applicable to gravure printing.

The carriage preferably also carries one or more devices arranged to clean the cylinder and/or to clean one or more doctor blades arranged to act on the cylinder, which cleaning devices may comprise means for dispensing a jet or spray of fluid. The cleaning devices advantageously dispense a jet or spray of liquid for cleaning, followed by an air jet to remove excess cleaning liquid.

The carriage may be arranged to carry a reservoir of ink to supply the ink delivery device, preferably by gravity so that no pumps are needed. Instead, such a reservoir could be mounted separately.

The ink delivery device and its reservoir, together with any connecting pipework, are advantageously arranged to be mounted on and removed from the carriage as a unit, to avoid the need to clean them out in situ. Preferably, the carriage is arranged to carry two ink delivery devices, each of which can be replaced while printing is taking place using ink from the other. That avoids the need to change the ink unit during the wash cycle, thereby further simplifying and shortening the wash cycle.

The present invention also provides a rotary printing machine comprising two devices, each arranged to deliver ink directly to the surface of the cylinder or to a doctor blade acting on the cylinder, each of which devices can be replaced while printing is taking place using ink from the other.

The present invention further provides a method of rotary printing comprising delivering ink from two devices in succession directly to the surface of the cylinder or to a doctor blade acting on the cylinder, and replacing one of those devices while printing is taking place using ink from the other.

The invention is especially applicable to gravure printing.

The printing machine may comprise a device extending the length of the cylinder for cleaning the cylinder, in addition to any cleaning devices on the carriage. Such a cylinder-cleaning device may comprise a trough extending the length of the cylinder under the cylinder, and one or more fluid spray or jet devices in or above the trough and, like the rest of the apparatus, is preferably arranged to operate without needing a human cleaner near the moving parts of the machine.

One form of printing apparatus constructed in accordance with the invention, and a method of printing in accordance with the invention, will now be described by way of example only with reference to the accompanying drawings, in which:

DETAILED DESCRIPTION

Figure 1:
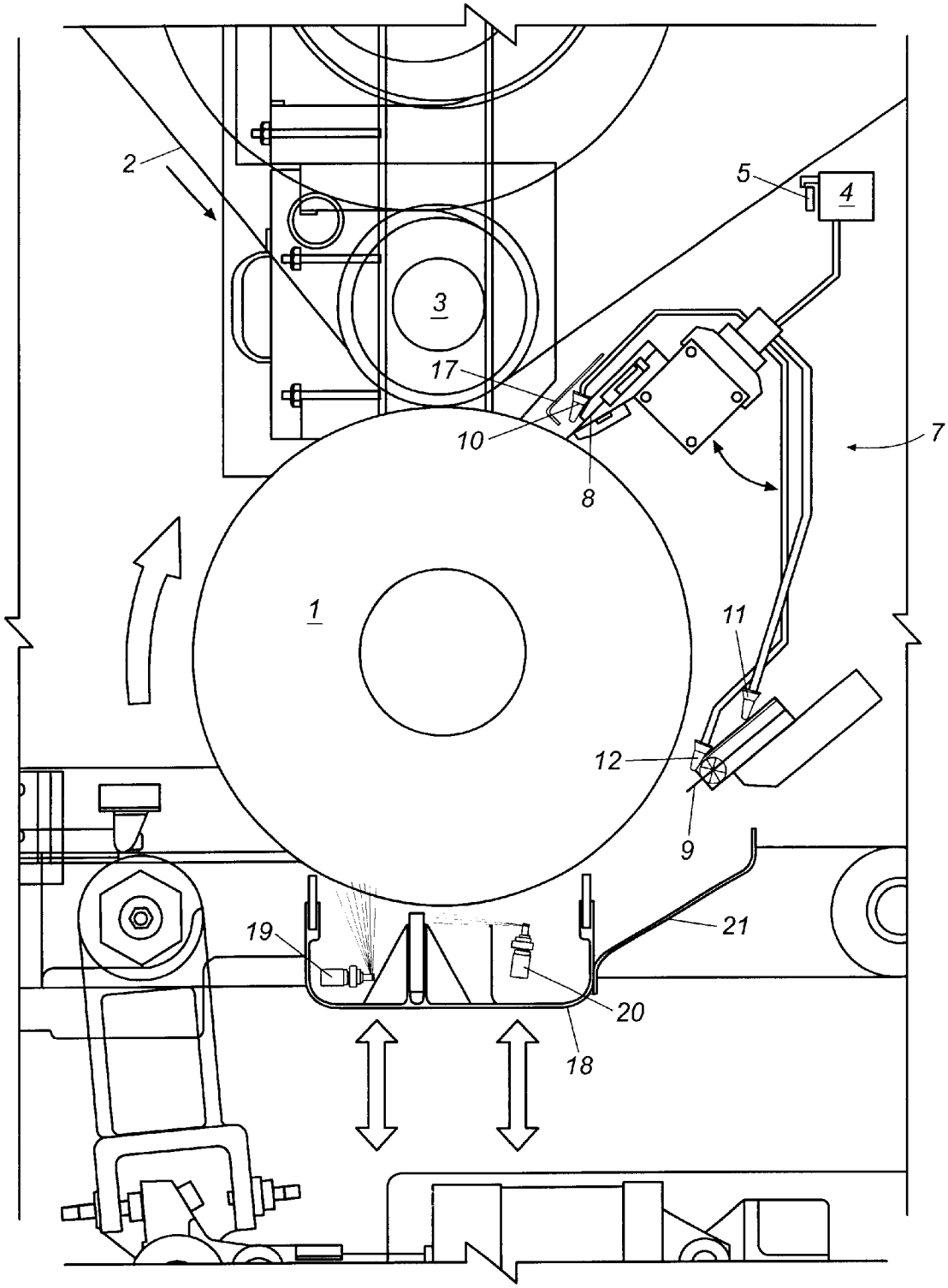
FIG. 1 is a schematic sectional view through part of the machine.
Figure 2:
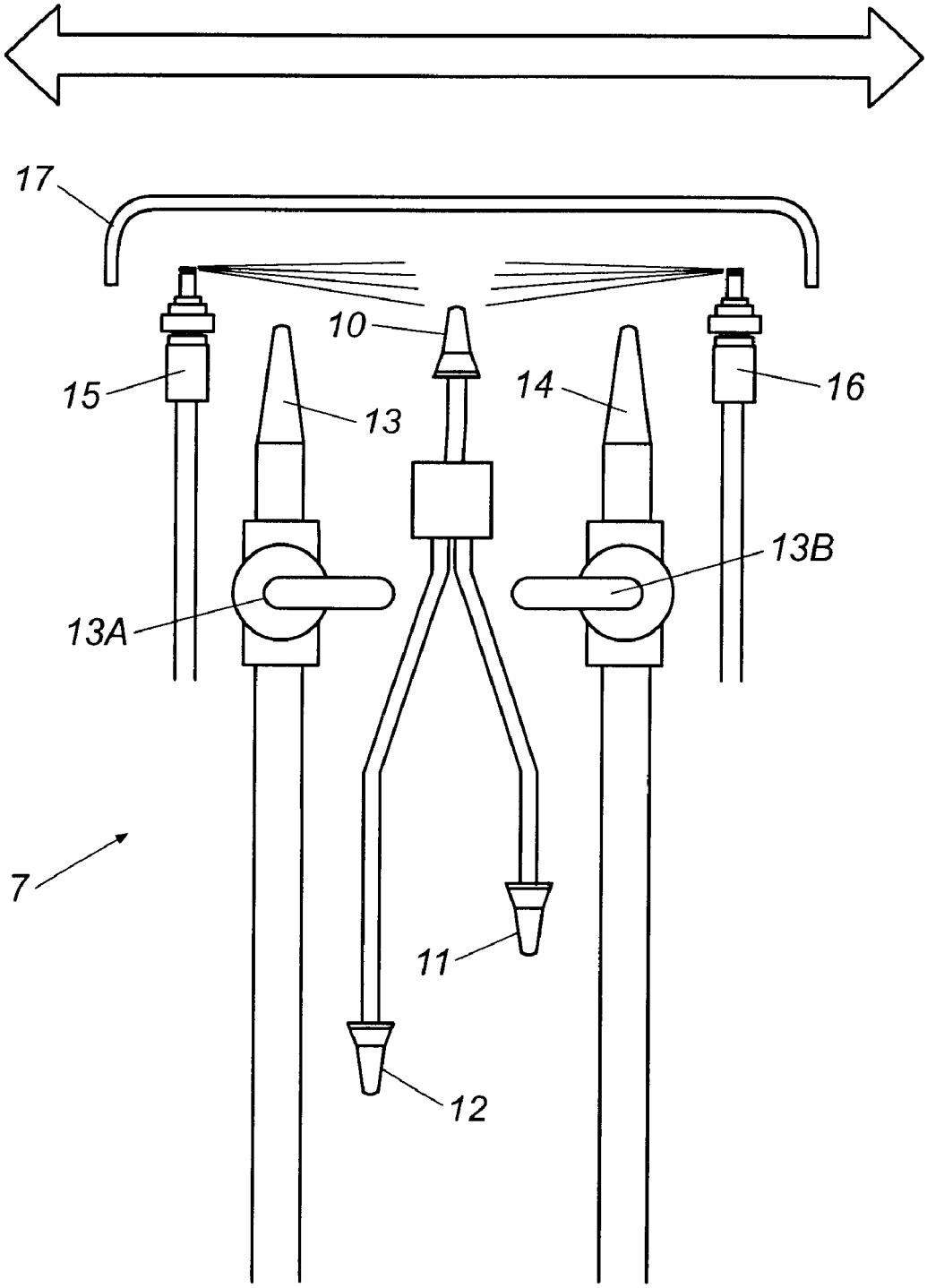
FIG. 2 is a schematic view of part of the device shown in FIG. 1.

Referring to the accompanying drawings, one form of rotary gravure printing machine comprises a printing cylinder 1 arranged to rotate about its axis, which is horizontal, and having a design to be printed engraved or otherwise recessed into its surface. A web of material 2 onto which the design is to be printed is fed past the upper edge of the cylinder, and pressed into contact with the cylinder by a pressure roller 3. Those parts of the apparatus may be entirely conventional and, in the interests of conciseness, will not be described in more detail. It will be understood that the printing machine may have several cylinders 1 applying different colors successively to the web 2, in which case the present description may apply to any or all of the cylinders.

A carriage 4, not shown in detail, is mounted on a rail 5 extending lengthwise of the cylinder 1, and is propelled back and forth along the length of the cylinder by means, not shown, which may be conventional per se. The carriage 4 contains reservoirs of ink (not shown), and is arranged above the level of the cylinder so that the ink can be fed to the cylinder by gravity, as will be explained in more detail below. The carriage 4 also supports a head assembly, indicated generally by the reference number 7, that travels over the surface of the cylinder 1 as the carriage moves. If the web 2 is guided to a drying apparatus arranged above the printing cylinder 1, then the rail 5 may be disposed along the downstream side of the drying apparatus, to allow a substantial head for the gravity feed. The web may then be led out of the top of the drying apparatus, over the rail, and only then down to the next stage of the production process.

Two doctor blades, an upper, cascade blade 8 and a lower, ink blade 9, are positioned to engage the descending surface of the cylinder. The head assembly 7 includes wash water jets 10, 11, & 12 aimed at both doctor blades 8 and 9, ink nozzles 13 and 14 positioned to deliver ink onto the upper surface of the cascade blade 8, and air jets 15 and 16 arranged to direct a jet of air over the surface of the cascade blade 8. Each ink nozzle 13 and 14 is provided close to the tip of the nozzle with a shut-off valve 13A and 13B respectively, for the ink supply.

Each ink nozzle 13 or 14, together with its associated ink reservoir and the gravity-feed pipe connecting them, forms a unit arranged to be quickly and easily mounted on and removed from the carriage 4 and head assembly 7. Screens, as shown symbolically at 17, may be provided to reduce splashing of ink and/or wash water.

A trough 18, with wash water sprays 19 and 20, is provided under the lowest portion of the cylinder. The trough 18 also carries a collection tray 21 for wash water falling from the ink blade 9.

In normal printing, the cylinder 1 rotates in the sense of the curved arrow in FIG. 1, with both doctor blades 8 and 9 in contact with it. One of the ink nozzles 13 or 14 supplies ink to the cascade blade 8 as the carriage 4 travels along the cylinder. The cascade blade 8 applies the ink to the cylinder in slight excess, which excess is removed by the ink blade 9. It has been found that with correct throttling of the gravity feed, the ink supply can be so regulated that a slight bead of ink is maintained on both doctor blades, ensuring even inking of the cylinder 1, but that the ink does not build up to an extent that would require it to be removed. It will be appreciated that the amount of ink on the cascade blade 8 must be sufficient to buffer the time between successive passes of the nozzle 13 or 14, especially at the ends of the cylinder, where passes in opposite directions are not evenly spaced.

When it is desired to change ink, the supply to the nozzle 13 or 14 may be shut off. Preferably, however, the amount of ink in the reservoir is calculated to run out at the point when a change will be required, so that no ink is wasted. The doctor blades are then washed by means of the wash water jets 10 to 12, and the cylinder 1 is washed by means of the wash water jets 19 and 20. The air jets 15 and 16 are then used to drive off excess wash water, so that it does not contaminate the new ink. The ink supply to the other nozzle 14 or 13 is then switched on, and printing resumes in the new colour. It has been found in practice that a colour change can be carried out quickly enough for the printing machine to be left running during the change. A small amount of the web 2 is wasted, but the cost of that is less than the cost of extra down-time in stopping and re-starting the machine. Where the printing machine has more than one cylinder 1 equipped in accordance with the invention, the colour changes at successive cylinders are preferably timed so that the same portion of web 2 is affected at each cylinder in turn, thereby minimising the amount of wasted web.

The finished ink reservoir, together with its nozzle 13 or 14 and connecting pipework, may then be removed from the carriage as a unit, and replaced with a fresh unit charged with ink for the next colour change. It is preferred to stop the carriage 4 at one end of its travel for the change, but with suitable mounting of the ink unit the change can be made without stopping the machine, using up part of the reserve of ink on the cascade blade 8. The ink unit that has been removed from the machine may then be cleaned and refilled elsewhere, without affecting operation of the machine.

Although in the interests of conciseness the above description refers to wash water, it will be understood that, especially where solvent-based inks are being used, some or all of the washing may be done with a liquid other than water, or containing components other than water, for example, an organic solvent.

As an example, with a printing machine according to the invention printing onto a vinyl web 4 meters wide moving at 60 m/min with a water-based ink applied at several $g/m^2$, it is possible to change inks in less than 30 seconds, generating only about a liter of wash water for each cylinder.

Various changes may be made to the specific embodiment that has been described. For example, the cascade blade may be omitted, and the ink nozzles 13 and 14 arranged to apply the ink, for example in a jet, directly onto the surface of the cylinder 1. For example, the ink blade 9 may be positioned anywhere on the arc of the cylinder from the point where the ink is applied to the point of contact with the web 2, or it may be possible to dispense with the ink blade 9 entirely.

The washing device 18 to 20 for the cylinder may be retracted away from the cylinder when not in use, as shown by the double-headed arrows in FIG. 1.

What is claimed is:

1. A rotary printing machine comprising a cylinder, a carriage arranged to reciprocate along said cylinder, said carriage carrying at least one cleaning device arranged to clean said cylinder, and at least one delivery device arranged to deliver ink to the surface of said cylinder, and at least one doctor blade acting on said cylinder.

2. A printing machine as claimed in claim 1, wherein said cleaning device includes means for dispensing a jet of fluid.

3. A printing machine as claimed in claim 1, wherein said cleaning device includes means for dispensing a jet of fluid and means for removing surplus fluid with a jet of gas.

4. A printing machine as claimed in claim 1, wherein the ink is arranged to be supplied to the delivery device by gravity.

5. A printing machine as claimed in claim 1, wherein said delivery device is arranged to be mounted on and removed from said carriage as a unit.

6. A printing machine as claimed in claim 1, wherein said carriage is arranged to carry two of said delivery devices, at least one of said delivery devices being replaceable while printing is taking place using ink from the other one of said delivery devices.

7. A printing machine as claimed in claim 1 and further comprising a cylinder cleaning device extending the length of said cylinder for cleaning said cylinder.

8. A printing machine as claimed in claim 7, wherein said cylinder cleaning comprises a trough extending the length of and underlying said cylinder and at least one pray device disposed over said trough.

9. A printing machine as claimed in claim 1 and wherein said at least one doctor blade comprises at least two doctor blades acting on said cylinder.

* * * * *